US005233733A

United States Patent [19]

Rich et al.

[11] Patent Number: 5,233,733

[45] Date of Patent: Aug. 10, 1993

[54] SHEET MATERIAL SHRINKAGE APPARATUS

[75] Inventors: Gerard Rich, Orschwihr; Gilbert Zimmerman, Steinbach, both of France

[73] Assignee: Rollin S.A., Cernay, France

[21] Appl. No.: 948,338

[22] Filed: Sep. 21, 1992

Related U.S. Application Data

[63] Continuation of Ser. No. 682,781, Apr. 9, 1991, abandoned.

[30] Foreign Application Priority Data

Apr. 12, 1990 [FR] France ..... 90 04750

[51] Int. Cl.[5] ..... D06C 21/00

[52] U.S. Cl. ..... 26/18.6

[58] Field of Search ..... 26/18.6

[56] References Cited

U.S. PATENT DOCUMENTS

| | | | |
|---|---|---|---|
| 3,342,656 | 9/1967 | Papageorges | 474/264 X |
| 3,453,900 | 7/1969 | Orndorff, Jr. et al. | 474/260 X |
| 3,469,292 | 9/1969 | Hojyo | 26/18.6 |
| 3,657,938 | 4/1972 | Fisher | 474/264 X |
| 3,938,399 | 2/1976 | Delfiol et al. | 474/264 X |
| 3,992,958 | 11/1976 | Bonnefon | 474/264 X |
| 4,051,215 | 9/1977 | Tsuruta | 26/18.6 X |
| 4,126,563 | 7/1979 | Lawrence et al. | 26/18.6 X |
| 4,127,039 | 11/1978 | Hollaway, Jr. | 474/264 X |
| 4,752,282 | 6/1988 | Habegger | 474/264 X |
| 4,808,149 | 2/1989 | Standley | 474/260 |
| 4,832,672 | 5/1989 | Bielfeldt | 474/260 |
| 4,888,860 | 12/1989 | Metzen et al. | 26/18.6 |
| 4,908,918 | 3/1990 | Strahm et al. | 26/18.6 |
| 4,969,243 | 11/1990 | Strahm | 26/18.6 |
| 5,016,708 | 5/1991 | Baer et al. | 474/264 X |

FOREIGN PATENT DOCUMENTS

| | | | |
|---|---|---|---|
| 0351482 | 10/1988 | European Pat. Off. . | |
| 0295354 | 12/1988 | European Pat. Off. . | |
| 1425075 | 2/1965 | France . | |
| 174597 | 4/1976 | New Zealand . | |
| 782195 | 9/1957 | United Kingdom | 474/264 |
| 899545 | 6/1959 | United Kingdom . | |
| 1390603 | 12/1970 | United Kingdom . | |
| 1397521 | 6/1975 | United Kingdom . | |
| 1491175 | 11/1977 | United Kingdom . | |
| 1521069 | 8/1978 | United Kingdom . | |

*Primary Examiner*—Clifford D. Crowder
*Assistant Examiner*—John J. Calvert
*Attorney, Agent, or Firm*—Craig K. Leon; William L. Baker

[57] ABSTRACT

An exemplary sheet material shrinkage apparatus comprises an endless belt mounted on rotatable cylinders and disposed against a shrinkage cylinder, the belt comprising inward and outward elastomer layers having different elasticity properties.

11 Claims, 1 Drawing Sheet

SHEET MATERIAL SHRINKAGE APPARATUS

This is a continuation of application Ser. No. 07/682,781 filed Apr. 9, 1991, now abandoned.

FIELD OF THE INVENTION

The present invention relates to annular elements for textile machinery, and in particular an endless belt co-operative with at least one cylinder to shrink a sheet material interposed between the belt and the cylinder and machine for shrinking fabrics fitted with this belt.

BACKGROUND OF THE INVENTION

The subject matter of the present invention essentially is an endless belt cooperative with at least one cylinder for shrinking a sheet material such as fabric or paper interposed between the belt and the cylinder.

It is also directed to a machine fitted with this belt for shrinking fabrics and other materials.

Machines have long been known for shrinking fabrics, and in particular, machines which comprise a shrinking station wherein fabric is driven between a heated cylinder and an endless belt which passes around a plurality of rolls.

However, belts or sleeve used heretofore in shrinking machines of the kind referred to hereinabove were made from a single material and in particular exhibited the inconvenience of allowing a limited shrinkage only of the fabric, i.e. a shrinkage which may not exceed a certain threshold which may be disadvantageous for certain types of fabric requiring a great shrinkage.

SUMMARY

In surmounting the disadvantages of the prior art, the present invention provides an improved endless belt capable of imparting to fabric or to any other sheet material a much greater shrinkage than that provided by the known endless belts.

For that purpose the present invention provides an endless belt adapted to co-operate with at least one cylinder for shrinking a sheet material such as fabric, paper, or other material interposed between the belt and the cylinder and subjected to change in curvature of the belt driving this material, characterized in that the belt is made from at least two materials, one of which constituting the thickness fraction of the belt towards the sheet material is more flexible than the other material constituting the other thickness fraction or remaining fraction of the belt so as to confer upon the latter differential elasticity properties adapted to the material to be shrunken.

In a further exemplary embodiment of the present invention, a core material possible reinforced with fibers is provided between the two belt layers.

It should be specified here that both thickness fractions of the belt are preferably made from an elastomer having a different modulus of elasticity lying between about 0.1 and 10 megapascals (MPa).

According to still a further characterising feature of the belt according to the invention the thickness of each one of both thickness fractions of the belt is lying between about 1 and 50 mm whereas the thickness of the core is lying between about 0 and 50 mm.

It should further be specified here that this belt may comprise an embossing such as notches, goffers, grooves or the like on its surface opposite to that in engagement with the sheet material.

The invention further provides a machine for shrinking fabrics or other materials in particular comprising a shrinkage station with an endless belt driving the fabric and co-operating with a heating cylinder, the belt having characteristics as described above and in further detail herein.

In a further exemplary embodiment, the invention provides a fabric sheet shrinkage apparatus comprising a shrinkage cylinder and an endless belt having an inner layer disposed around three spaced-apart mounting cylinders and having an outer layer disposed against said shrinkage cylinder, said outer belt layer having a greater modulus of elasticity than said inner belt layer and forming a convex curvature in said belt against said shrinkage cylinder whereby a sheet of fabric, when introduced between said belt and cylinder when rotating together, is shrunken by the differential elasticity properties of said first and outer belt layers against said shrinkage cylinder.

DESCRIPTION OF THE DRAWINGS

Now further characteristics and advantages of the invention will be more readily understood in the detailed description which follows and refers to the annexed drawings given by way of example only and wherein.

DETAILED DESCRIPTION OF THE INVENTION

Figure 1:
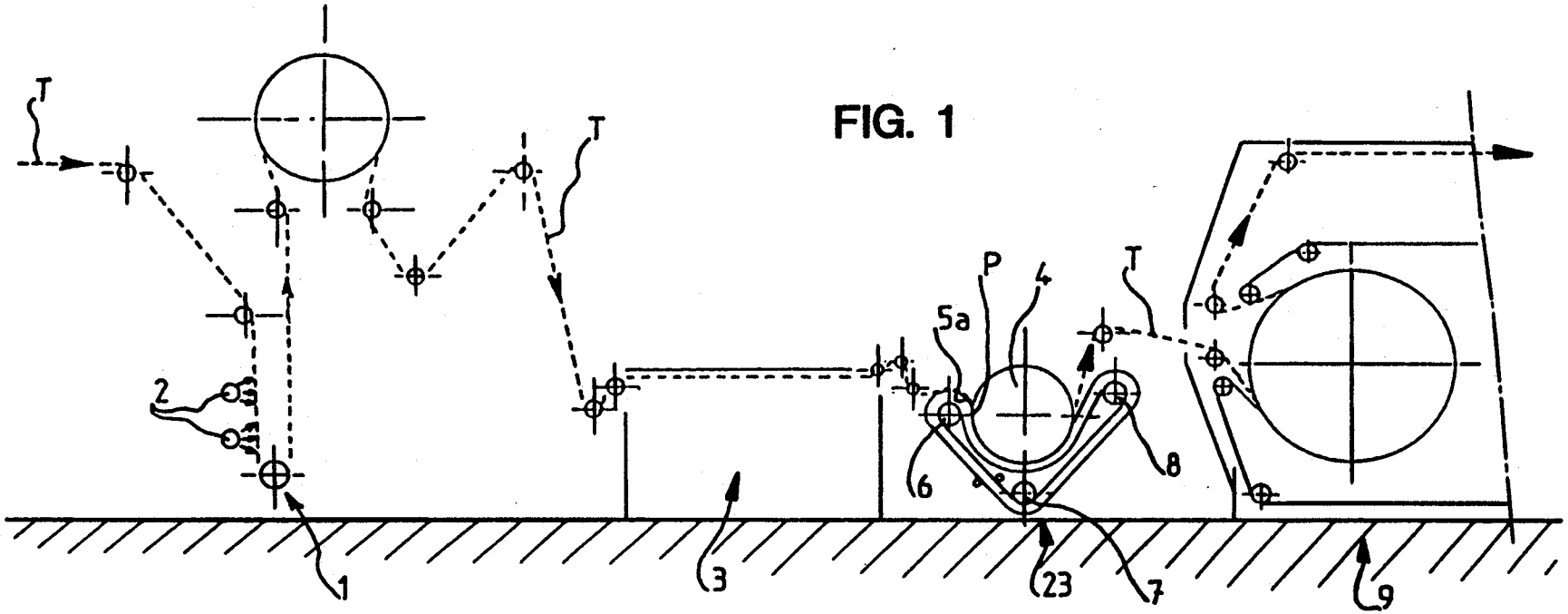
FIG. 1 is a diagrammatic elevational view of a machine for shrinking fabrics in particular comprising a shrinkage station fitted with a belt according to the invention.

On FIG. 1 is seen a machine known per se permitting the shrinkage through compression of fabrics, i.e. the squeezing of the weft and warp threads to provide in a way for a blocking of the fabric. Thus the fabric acquires a very great dimensional stability characterized by a permanent state and maintenance of the shape and size of the article made with this fabric.

The fabric exhibits the shape of a web designated at T on FIG. 1 and is at first moistened at the station 1 by steam and/or by water sprayed by nozzles or the like 2.

The fabric then passes onto a device 3 of a type known per se imparting to the fabric web T a constant width and adapted to allow the said web to pass into a shrinkage station generally designated at 23.

This shrinkage station essentially comprises a heating cylinder 4 co-operating as shown with a sleeve-like endless belt 5 passing around three rolls 6, 7 and 8. The fabric web T passes between the heating cylinder 4 and the sleeve 5 which with its outer surface 5*a* drives the said web which may slide onto the periphery of the cylinder 4. More specifically the sleeve 5 rotates about the heating cylinder 4 while being guided by the rolls 6, 7 and 8 which are bending its path of travel. The fabric input roll 6 is operable by a pressurizing system (not shown) which applies the sleeve 5 against the cylinder 4. The roll 8 placed at the exit of the fabric web T from the shrinkage station 23 is disengaged from the cylinder 4 and allows the adjustment in tension of the sleeve 5 during use. At last the intermediate roll 7 is positioned in the lower portion of the shrinkage station 23 as well seen on FIG. 1.

As is understood the fabric web T is driven at the point of compression P of the intake roll 6 between the outer surface 5a of the sleeve 5 and the periphery of the heating cylinder 4. It is there, i.e. beyond the compression point P where the shrinkage of the fabric is effected in view of the reversal of the curvature of the sleeve 5. It is seen indeed on FIG. 1 that the outer surface 5a of the fabric web T above the inlet roll 6 is convex-curved whereas it is concave-curved beyond the point P so that the fabric clinging to the surface will shrink itself at this place on account of the "elastic shrinkage" generated by the concave shaping of the outer surface 5a of the sleeve 5.

The advancing of the fabric between this sleeve 5 and the heated cylinder 4 will provide for a first fixing of the new arrangement of the wrap and weft threads of the previously shrunken fabric.

The fabric web T then leaves the shrinkage station 23 to reach a calendering station 9 which allows the fabric web to dry and especially to complete its fixing and therefore to freeze the shrinked arrangement of the warp and weft threads of the web of fabric.

Reverting to the shrinkage station 23 it is important to note here that the shrinkage induced by the change in curvature of the sleeve as previously explained is limited and may not go beyond a certain threshold in view of the fact that the sleeve 5 is made from a single material.

Figure 2:
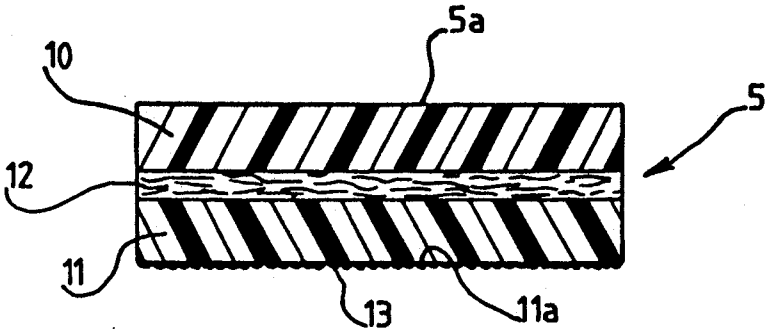
FIG. 2 is a cross-sectional view of an exemplary belt of the present invention.

According to the invention and as seen on FIG. 2 the endless belt or sleeve 5 is made from two materials one of which is more flexible than the other one. More specifically the thickness fraction or layer 10 of the belt 5 located towards the web of fabric or any other similar material and therefore comprising the outer surface 5a previously mentioned is more flexible than the other material constituting the other thickness fraction or layer 11 which comprises the inner surface of the belt or sleeve 5.

Although this is not compulsory it is possible to provide between both thickness frations or layers 10, 11 an additional material forming the core of the belt 5 which core may possible be reinforced with fibres.

Both layers 10, 11 are made from an elastomer therefore having a different modulus of elasticity which may lie between 0.1 and 10 MPa.

The thickness of both layers 10, 11 may be variable in accordance with the nature of the fabric to be processed and may lie between for instance 1 and 50 mm.

If present, the intermediate core layer 12, which is positioned between layers 10 and 11 as shown in FIG. 2, may have a thickness not exceeding about 50 mm.

Also the inner layer 11 of the sleeve 5 may comprise embossings forming for instance notches, goffers, grooves or the like on its surface 11a opposite to the outer surface 5a in engagement with the fabric or the like T as diagrammatically shown at 13. Thus will be advantageously achieved a good clinging of the sleeve or of the belt 5 onto the rolls 6, 7 and 8 which may but improve the effectiveness of the shrinkage station 23.

But it is especially important to note that owing to the provision of two layers or thickness 10, 11 of differing flexibilities for the belt 5, this belt will have differential elasticity properties adapted to the sheet material such as fabric, paper or the like which is desired to be shrinked.

More specifically when the belt or sleeve 5 makes a curve a greater deformation of the outer surface 5a of the layer 10 is associated with a layer 11 which is harder whereas if as in the prior art the sleeve is made from a single material a less greater deformation of the outer surface 5a in the curves will be achieved.

This means that with the sleeve according to the invention for a given length of fabric passing onto the intake roll 6 of the shrinkage station 23 there will be obtained after the compression point P, i.e. at the change in curvature of the sleeve a shrinkage of the fabric which together with the sleeve according to the invention is definitely superior to that which would be obtained with a sleeve made from a single material according to the prior art.

The magnitude of the shrinkage on the fabric depends of course on the thicknesses and relative moduli of elasticity of both layers or thickness frations 10, 11 of the sleeve 5.

It should be understood that the invention is not at all limited to the embodiment described and illustrated which has been given by way of example only.

Thus the core 12 of the sleeve 5 could be present or absent and the thicknesses or the different moduli of elasticity of both layers 10 and 11 may be of any value whatsoever and adapted to the sheet materials such as fabrics, papers or the like which desirably are to be shrinked.

The foregoing examples are provided for illustrative purposes only and are not intended to limit the invention. As modifications may be evident to those skilled in the art, the scope of the invention is limited only by the following claims.

We claim:

1. A fabric sheet shrinkage apparatus comprising:

a shrinkage cylinder and an endless belt comprising inner and outer elastomer layers having a different modulus of elasticity between 0.1 and 10 MPa, said inner elastomeric layer disposed around three spaced-apart mounting cylinders and said outer elastomeric layer disposed against said shrinkage cylinder and having a greater modulus of elasticity than said inner elastomeric belt layer and forming a convex curvature in said belt against said shrinkage cylinder whereby a sheet of fabric, when introduced between said belt and cylinder when rotating together, is shrunken by the differential elasticity properties of said inner and outer elastomer belt layers against said shrinkage cylinder.

2. The apparatus of claim 1 wherein the rotatably mounted belt is mounted around at least two rotatable mounting cylinders.

3. The apparatus of claim 2 wherein said shrinkage cylinder is heated.

4. The apparatus of claim 3 wherein said belt layers have thicknesses between 1 and 50 mm.

5. The apparatus of claim 4 wherein said belt further comprises a core material disposed between said layers.

6. The apparatus of claim 5 wherein said core material is reinforced with fibers.

7. The apparatus of claim 1 wherein said inward belt layer further comprises notches, goffers, grooves, or other embossing.

8. The apparatus of claim 1 further comprising a water spray station operative to moisten fabric to be introduced into said convex curvature.

9. The apparatus of claim 1 further comprising a calendering apparatus operative to receive a fabric sheet having warp and weft threads, said sheet being shrunken between said shrinkage cylinder and said belt, and to fix the shrinked arrangement of warp and weft threads of said fabric sheet.

10. A sheet material shrinkage apparatus, comprising: a rotatably mounted shrinkage cylinder and an endless rotatably mounted belt comprising inner and outer elastomer layers having a modulus of elasticity in the range of 0.1–10 MPa, said inner elastomer layer and outer elastomer layer disposed against said shrinkage cylinder to form a convex curvature to sheet material introduced between said cylinder and belt, said outer elastomer layer having a greater modulus of elasticity than said inner elastomer layer and thereby having a greater deformation than said inner layer when said outer layer is disposed against said rotatably mounted shrinkage cylinder, whereby a sheet material introduced within the convex curvature is shrunken.

11. A sheet material shrinkage apparatus comprising a shrinkage cylinder and an endless belt having an inner elastomeric layer and an outer elastomeric layer, said outer layer having a greater modulus of elasticity than said inner layer, said belt having a rectangular cross-section, and said cylinder and endless belt each being rotatably mounted such that said belt outer layer is disposed against and forms a convex curvature with said shrinkage cylinder whereby a sheet material interposed between said belt and shrinkage cylinder is shrunken.

* * * * *